United States Patent [19]

Efther et al.

[11] 4,076,972

[45] Feb. 28, 1978

[54] LIQUID CONTACT SWITCH HAVING PLURAL COMPARTMENTS AND ELECTRICAL HEATER

[76] Inventors: Jean Efther, 20, rue de l'Aubepine, Antony, France, 92160; Jean Denisselle, 43 B^d Victor, Paris, France, 75015

[21] Appl. No.: 685,097

[22] Filed: May 10, 1976

[51] Int. Cl.[2] ..... H01H 29/00

[52] U.S. Cl. ..... 200/33 A; 200/185; 200/186

[58] Field of Search ..... 200/182, 183, 184, 185, 200/186, 220, 221, 222, 33 A; 337/21, 121, 331

[56] References Cited

U.S. PATENT DOCUMENTS

| | | | |
|---|---|---|---|
| 1,094,440 | 4/1914 | Hatfield | 200/33 A |
| 1,954,364 | 4/1934 | Nacey et al. | 200/221 |
| 2,484,110 | 10/1949 | Mestitz | 200/186 X |
| 2,577,653 | 12/1951 | Dysart | 200/185 X |
| 2,583,434 | 1/1952 | Meyer | 200/33 A |

FOREIGN PATENT DOCUMENTS

| | | | |
|---|---|---|---|
| A21,391 | 5/1920 | France | 200/184 |
| 918,125 | 1/1947 | France. | |
| 1,298,137 | 5/1962 | France. | |
| 609,654 | 10/1948 | United Kingdom | 200/33 A |
| 870,830 | 6/1961 | United Kingdom | 200/221 |

*Primary Examiner*—James R. Scott
*Attorney, Agent, or Firm*—George H. Mitchell, Jr.

[57] ABSTRACT

An electrical switch of the liquid contact type having a housing divided into three compartments: (1) a power compartment having electrodes, (2) a control compartment containing a resistor and (3) an intermediate compartment communicating with the power compartment through a lower channel and communicating with the control compartment through an upper channel containing a wick. The wick prevents liquid flow but permits gaseous flow.

A body of electrically conductive liquid is normally contained in the intermediate compartment so that when the resistor is heated, the gas in the control compartment is expanded and passes into the intermediate compartment thereby forcing the conductive liquid into the power compartment to establish a circuit between the two electrodes.

9 Claims, 4 Drawing Figures

Fig.1.
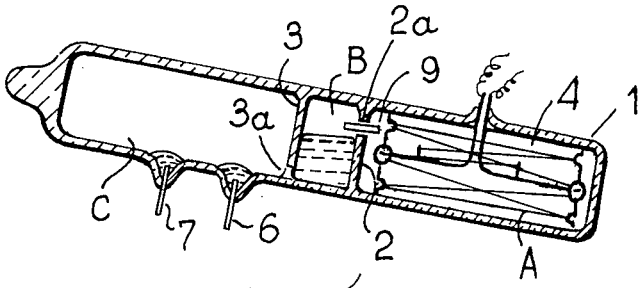
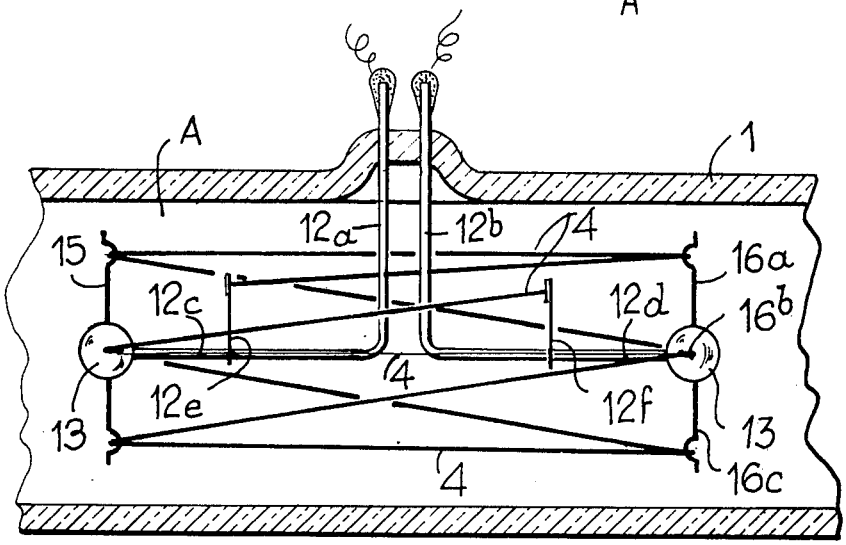
Fig.2.
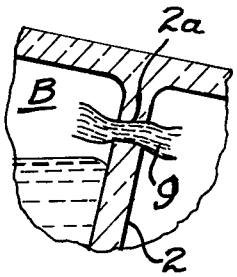
Fig.4
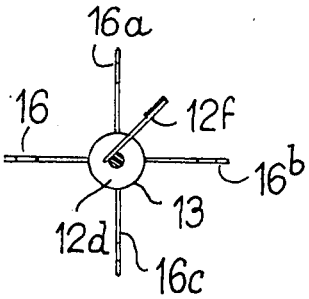
Fig.3.

LIQUID CONTACT SWITCH HAVING PLURAL COMPARTMENTS AND ELECTRICAL HEATER

FIELD OF THE INVENTION

The invention relates to electrical switches of the type comprising a general insulating reservoir of fixed ampoule, a quantity of a liquid electrical conductor capable of establishing a contact between two electrodes connected to the terminals of a control circuit, the liquid conductor being displaceable to and from a position in which it establishes contact between the electrodes to a position in which this contact is broken by modifying the pressure of a gas displacing the liquid conductor, modification being effect by placing into or out of circuit an electrical resistor immersed in the said gas.

DESCRIPTION OF THE PRIOR ART

It is known that a liquid conductor, such as mercury, may be displaced by expanding a gas located above the level of the mercury in order to produce an electrical connection between two electrodes.

This is the case for example, in the time switches as described in French Pat. Nos. 1,298,137 and 956,883 for the flasher described in French Pat. No. 918,125 and for the circuit breaker described in U.S. Pat. No. 2,577,653.

None of these patents, however, describes means allowing the three functions to be separated into three independent compartments communicating with one another only in a certain way and under certain conditions.

The object of this invention is to provide an improved electrical switch for a control circuit.

SUMMARY OF THE INVENTION

We have found by experiment that the volumes of the three compartments are interrelated by a relationship such that only by respecting it is it possible to secure reliability and regularity of operation.

We have found that the intermediate compartment needs to have a volume of between $\frac{1}{8}$ and $\frac{1}{3}$ of the volume of the control compartment (preferably 1/5), and likewise between $\frac{1}{8}$ and $\frac{1}{2}$ of that of the power compartment.

The volumes of the control and power compartments located on either side of the intermediate compartment should preferably have a ratio of between 0.75:1 and 1.25:1, most preferably 1:1.

Finally, the utmost attention must be given to the position of the resistor in the control reservoir, so as to produce uniformly distributed heating of the gas in the confines of the control compartment.

The present invention provides an electrical switch which comprises a general insulating reservoir, a quantity of a liquid electrical conductor capable of establishing contact between two electrodes for connection to the terminals of a control circuit, the liquid conductor body being displaceable to and from a position in which it establishes contact between the electrodes and a position in which this contact is broken by variation in the pressure of a gas displacing the liquid conductor, resulting from expansion of this gas due to energization of an electrical resistor immersed in the gas. The general reservoir is tilted and is divided into three impermeable compartments, a power compartment at the bottom of which are located the two electrodes, a control compartment enclosing the reservoir for the liquid conductor, and a power compartment. The conductive liquid moves between the power compartment and the reservoir through a channel at the lowest part of the power compartment and the reservoir communicates with the control compartment by means of a channel arranged in the upper part of the reservoir so as to permit passage of the gas and to resist passage of the liquid conductor.

Because the reservoir is slightly inclined, the liquid conductor can return by gravity and by pressure difference to the intermediate compartment through the communicating channel and, having once been displaced, the mercury stays in the lower part of the power compartment and covers the cups in which the electrodes are located, thus ensuring contact.

DESCRIPTION OF THE DRAWING

Other features and advantages of the invention will emerge in the course of the following description which, having reference to the attached Drawing provided by way of example without limitation, will explain how the present invention can be put into practice.

FIG. 1 is a sectional view of the switch according to the invention,

FIG. 2 is a large scale view of the control compartment,

FIG. 3 shows a preferred arrangement of the resistor, and

FIG. 4 is a fragmentary view, on an enlarged scale, of the arrangement of the wick.

DETAILED DESCRIPTION OF THE PREFERRED EMBODIMENT

Referring now to the Drawings, as can be seen from FIG. 1, the switch which is the subject of the invention comprises a glass envelope or ampoule 1 heremetically sealed and divided into three compartments: a control compartment A, a reservoir compartment B, and a power compartment C.

Compartment A is separated from compartment B by a partition wall 2 penetrated by a channel **2*a*** located in its upper part.

Compartment B is separated from compartment C by a partition wall 3 penetrated by a channel **3*a*** located in its lower part and adjacent to the bottom wall of the envelope so as not to act as a sill.

Mercury is first placed in compartment B.

A wick is placed in channel **2*a*** so as to prevent the inadvertent passage of the mercury into compartment A (which would short-circuit the resistor), whilst allowing gas to pass.

Compartment C contains electrodes 6 and 7.

In the example illustrated, the volumes of compartments A and C are equal and the volume of the intermediate compartment B is $\frac{1}{4}$ of the volume of compartment A or C.

As will be seen from FIGS. 2 and 3, the resistor 4 located inside the control compartment A (Constituted for a voltage of 220V by a 15 micron wire resistor having a resistance of 6,000 ohms per meter and wound spirally on a mandrel having a diameter of 0.06 millimeter) is uniformly distributed in this compartment.

For this it is supported by two radial electrodes **12*a* and 12*b* connected to a source of current entering compartment A through sealed orifices, each of these two electrodes 12*a* and 12*b* being prolonged by a portion at right angles, respectively 12*c* and 12*d* carrying respective vanes 12*e* and 12*f***.

Each portion at right angles terminates in a spherical glass insulator 13, supporting respective radial arms 15 (15*a* - 15*b* - 15*c* - 15*d*) and 16 (16*a* - 16*b* - 16*c* -16*d*).

The resistor 4 is held between two opposite arms in such a way as to constitute a cluster of parallel wires and of wires converging towards spheres 13 in such a way as to occupy a maximum space inside compartment A.

In this way it is possible to accommodate a considerably length of wire, approximately 2.50 meters of spirally wound resistance wires, in a compartment approximately 30mm long and 10mm in diameter.

In consequence, the gas enclosed in A is heated rapidly with a minimum of thermal inertia, and so the switch "responds" in minimum time without surges.

The low volume of compartment B permits transmission of the resulting increased gas pressure to the mercury in compartment B without delay.

In addition, the equivalent volumes of A and C ensure an immediate contact between 6 and 7 (low initial pressure) and a speedy return to equilibrium as soon as resistor 4 is no longer energized.

Obviously, many modifications and variations of our invention as hereinbefore set forth may be made without departing from the spirit and scope thereof. Therefore only such limitations should be imposed as are indicated in the following claims.

We claim:

1. An electrical switch including a closed reservoir subdivided into three compartments comprising, a power compartment, a control compartment and an intermediate compartment, a body of electrically conductive liquid normally contained within said intermediate compartment, said power compartment and intermediate compartment being separated by a first impermeable wall provided with a first channel at the bottom thereof to allow the passage of said conductive liquid between the intermediate compartment and power compartment, the bottom wall of said power compartment being inclined to urge the return of liquid to the intermediate compartment and being provided with two spaced electrodes, said intermediate compartment and control compartment being separated by a second impermeable wall provided with a second channel above the normal level of the liquid conductor when contained in the intermediate compartment, and the electrical resistor in said control compartment for heating gas in said control compartment when energized, said second channel being provided with means to allow the passage of gas between compartments but to resist the passage of conductive liquid therethrough, whereby when the gas is heated by the energized resistor, pressure of the gas in the intermediate compartment is increased to displace conductive liquid into the power compartment to complete an electrical circuit between said two electrodes.

2. A switch as claimed in claim 1, wherein the resistor comprises a cluster of wires zigzagging around the control compartment whereby to occupy the maximum space.

3. A switch as claimed in claim 2, wherein the wires of the cluster are stretched between intersecting arms arranged at each end of the control compartment.

4. A switch as claimed in claim 3, wherein the intersecting arms are carried by insulators placed in the longitudinal axis of the compartment.

5. A switch as claimed in claim 4, wherein the insulators are carried by the axially directed extremities of the electrodes of the resistor.

6. A switch as claimed in claim 5, wherein the extremities of the resistor are carried by conducting vanes integral with the electrodes.

7. An electrical switch as claimed in claim 1, wherein the intermediate compartment has a volume between $\frac{1}{8}$ and $\frac{1}{3}$ of the volume of the control compartment.

8. An electrical switch as claimed in claim 1, wherein the volume of the intermediate compartment has a volume between $\frac{1}{8}$ and $\frac{1}{2}$ of the volume of the power compartment.

9. An electrical switch as claimed in claim 1, wherein the ratio between the volume of the power compartment and the volume of the control compartment is between 0.75:1 and 1.25:1.

* * * * *